US010829882B2

(12) United States Patent
Chupka

(10) Patent No.: US 10,829,882 B2
(45) Date of Patent: Nov. 10, 2020

(54) TRANSMISSION ASSEMBLY FOR A WASHING MACHINE APPLIANCE

(71) Applicant: Haier US Appliance Solutions, Inc., Wilmington, DE (US)

(72) Inventor: Edward Simeon Chupka, Bardstown, KY (US)

(73) Assignee: Haier US Appliance Solutions, Inc., Wilmington, DE (US)

( * ) Notice: Subject to any disclaimer, the term of this patent is extended or adjusted under 35 U.S.C. 154(b) by 331 days.

(21) Appl. No.: 15/815,787

(22) Filed: Nov. 17, 2017

(65) Prior Publication Data

US 2019/0153652 A1 May 23, 2019

(51) Int. Cl.

| | |
|---|---|
| ***D06F 37/02*** | (2006.01) |
| ***D06F 37/20*** | (2006.01) |
| ***D06F 37/26*** | (2006.01) |
| ***D06F 37/36*** | (2006.01) |
| ***D06F 37/40*** | (2006.01) |

(52) U.S. Cl.

CPC ..... *D06F 37/40* (2013.01); *D06F 37/20* (2013.01); *D06F 37/02* (2013.01); *D06F 37/26* (2013.01); *D06F 37/36* (2013.01)

(58) Field of Classification Search

CPC ..... D06F 37/02; D06F 37/20; D06F 37/26; D06F 37/36; D06F 37/40

USPC ..... 68/23.7

See application file for complete search history.

(56) References Cited

U.S. PATENT DOCUMENTS

| | | | | |
|---|---|---|---|---|
| 2,976,746 | A * | 3/1961 | Flannery | D06F 37/40 74/665 K |
| 6,077,184 | A | 6/2000 | Lee | |
| 2018/0127909 | A1* | 5/2018 | Cho | D06F 23/025 |

FOREIGN PATENT DOCUMENTS

| | | |
|---|---|---|
| JP | 3177119 B2 | 6/2001 |

* cited by examiner

*Primary Examiner* — Levon J Shahinian

(74) *Attorney, Agent, or Firm* — Dority & Manning, P.A.

(57) ABSTRACT

A washing machine appliance includes a rotatable wash basket and an agitator rotatably mounted within the wash basket. A rotor of a motor is selectively coupled to the wash basket and the agitator through a transmission assembly. The transmission assembly includes a planetary gear train including a plurality of helical gears. An input shaft is fixedly attached to the rotor and is operably coupled with the planetary gear train. A thrust bushing or bearing is positioned around the input shaft and a spring element is positioned between the thrust bushing or bearing and the rotor to prevent axial movement of the input shaft caused by the helical gears engaging each other when the direction of rotation of the input shaft changes.

20 Claims, 7 Drawing Sheets

TRANSMISSION ASSEMBLY FOR A WASHING MACHINE APPLIANCE

FIELD OF THE INVENTION

The present subject matter relates generally washing machine appliances, and more particularly to transmission assembles for washing machine appliances.

BACKGROUND OF THE INVENTION

Washing machine appliances generally include a wash tub for containing water or wash fluid, e.g., water and detergent, bleach, and/or other wash additives. A wash basket is rotatably mounted within the wash tub and defines a wash chamber for receipt of articles for washing, and an agitation element is rotatably mounted within the wash basket. Washing machine appliances are typically equipped to operate in one or more modes or cycles, such as wash, rinse, and spin cycles. For example, during a wash or rinse cycle, the wash fluid is directed into the wash tub in order to wash and/or rinse articles within the wash chamber. In addition, the wash basket and/or the agitation element can rotate at various speeds to agitate or impart motion to articles within the wash chamber, to wring wash fluid from articles within the wash chamber, etc.

Notably, it is frequently desirable for the wash basket and the agitation element to operate independently of each other or at different speeds. For example, during a wash or rinse cycle, the wash basket may remain stationary while the agitator rotates or oscillates back and forth. By contrast, during a spin cycle, typically both the agitator and the wash basket are rotated in unison so as to subject the articles in the laundry to centrifugal forces and cause water and other fluids to be wrung from the clothes. These liquids can exit the wash basket through holes positioned along the outer wall of the wash basket for subsequent removal from the wash tub.

In order to control the rotation of the agitation element and wash basket, certain washing machine appliances are equipped with a transmission assembly and a clutch for engaging and disengaging the wash basket from a motor that can be used to rotate the agitation element and/or wash basket. As the washing machine executes a cleaning process, the clutch is operated at certain times in order to provide the desired movement of the agitator and wash basket during one or more wash, rinse, and/or spin cycles.

Notably, however, conventional transmission assemblies include a planetary gear train with spur gears. Due to the noise generated by the spur gears, certain washing machine appliances now use transmissions with helical gears. However, when the motor reverses direction or provides a large torque, e.g., during oscillation of the agitation element, the helical gears may produce an axial force that can cause an undesirable clicking sound and premature wear to the transmission assembly. Although spacing washers may be used to lessen this noise, measuring the proper washer size is difficult and the assembly of the transmission is complicated significantly. Lowering the noise of the transmission assembly would be a commercially desirable improvement and simplifying assembly would lower costs and improve reliability.

Accordingly, a washing machine appliance that can shift between various modes or cycles of operation with minimal noise would be useful. More particularly, a transmission assembly for a washing machine appliance that is easy to assemble and generates less noise when oscillating would be particularly beneficial.

BRIEF DESCRIPTION OF THE INVENTION

The present disclosure relates generally to a washing machine appliance that includes a rotatable wash basket and an agitator rotatably mounted within the wash basket. A rotor of a motor is selectively coupled to the wash basket and the agitator through a transmission assembly. The transmission assembly includes a planetary gear train including a plurality of helical gears. An input shaft is fixedly attached to the rotor and is operably coupled with the planetary gear train. A thrust bushing or bearing is positioned around the input shaft and a spring element is positioned between the thrust bushing or bearing and the rotor to prevent axial movement of the input shaft caused by the helical gears engaging each other when the direction of rotation of the input shaft changes. Additional aspects and advantages of the invention will be set forth in part in the following description, or may be apparent from the description, or may be learned through practice of the invention.

In one aspect of the present disclosure, a washing machine appliance defining a vertical, a lateral, and a transverse direction is provided. The washing machine appliance includes a wash tub positioned within a cabinet and a wash basket rotatably mounted within the tub, the wash basket defining a wash chamber for receiving articles for washing. An agitator is rotatably mounted within the wash basket to impart motion to the articles within the wash chamber. A motor is operably coupled to a rotor and a transmission assembly selectively couples the rotor to the agitator and the wash basket. The transmission assembly includes a plurality of helical gears and an input shaft fixedly attached to the rotor and being operably coupled with at least one of the plurality of helical gears. A thrust bushing or bearing is positioned around the input shaft and a spring element is positioned between the thrust bushing or bearing and the rotor.

In another aspect of the present disclosure, a transmission assembly for selectively coupling a motor to an agitator and a wash basket of a washing machine appliance is provided. The transmission assembly includes a plurality of helical gears and an input shaft fixedly attached to a rotor of the motor and being operably coupled with at least one of the plurality of helical gears. A thrust bushing or bearing is positioned around the input shaft and a spring element is positioned between the thrust bushing or bearing and the rotor of the motor.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures.

Figure 1:
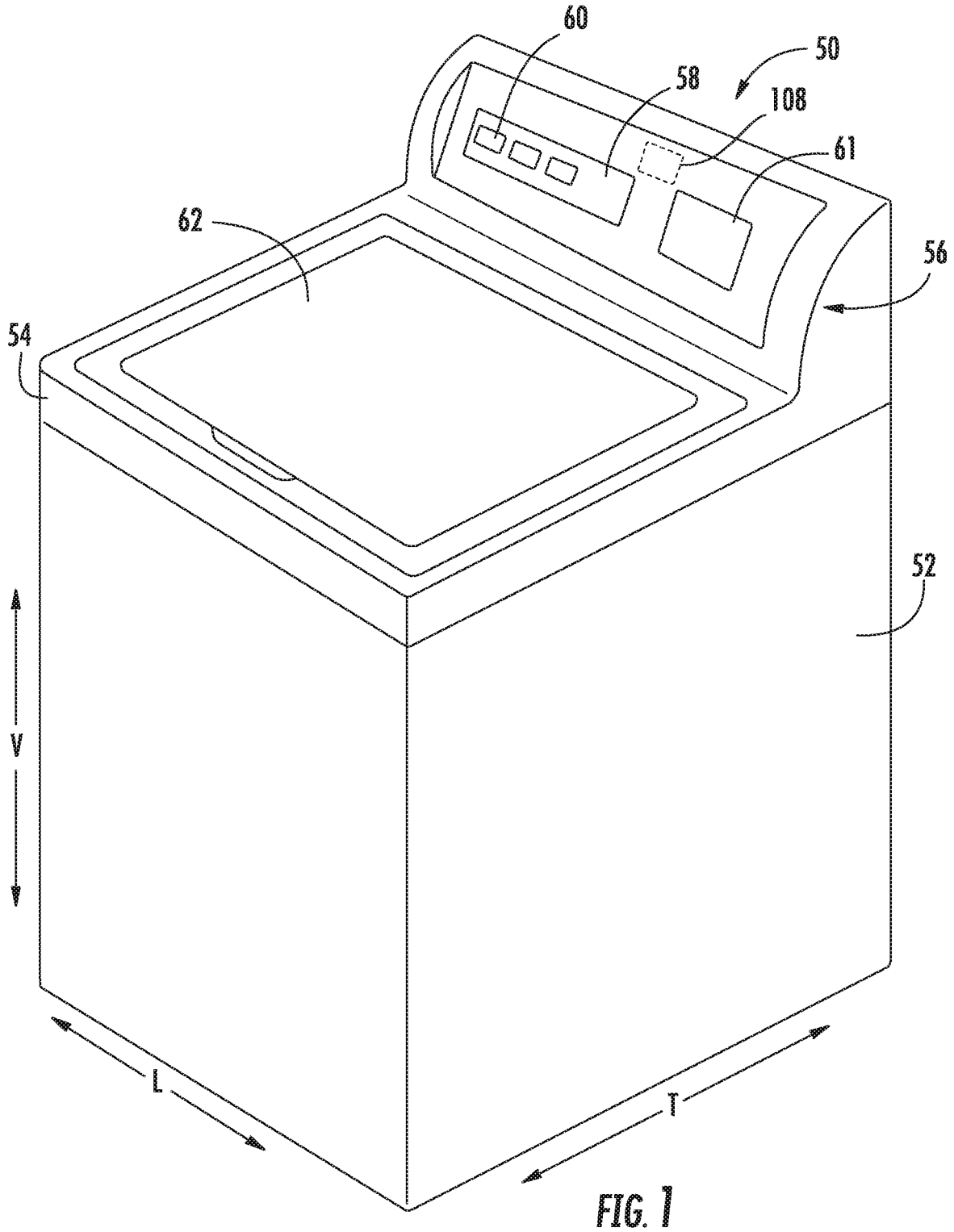
FIG. 1 provides a perspective view of a washing machine appliance according to example embodiments of the present disclosure.

Repeat use of reference characters in the present specification and drawings is intended to represent the same or analogous features or elements of the present invention.

DETAILED DESCRIPTION

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

Figure 2:
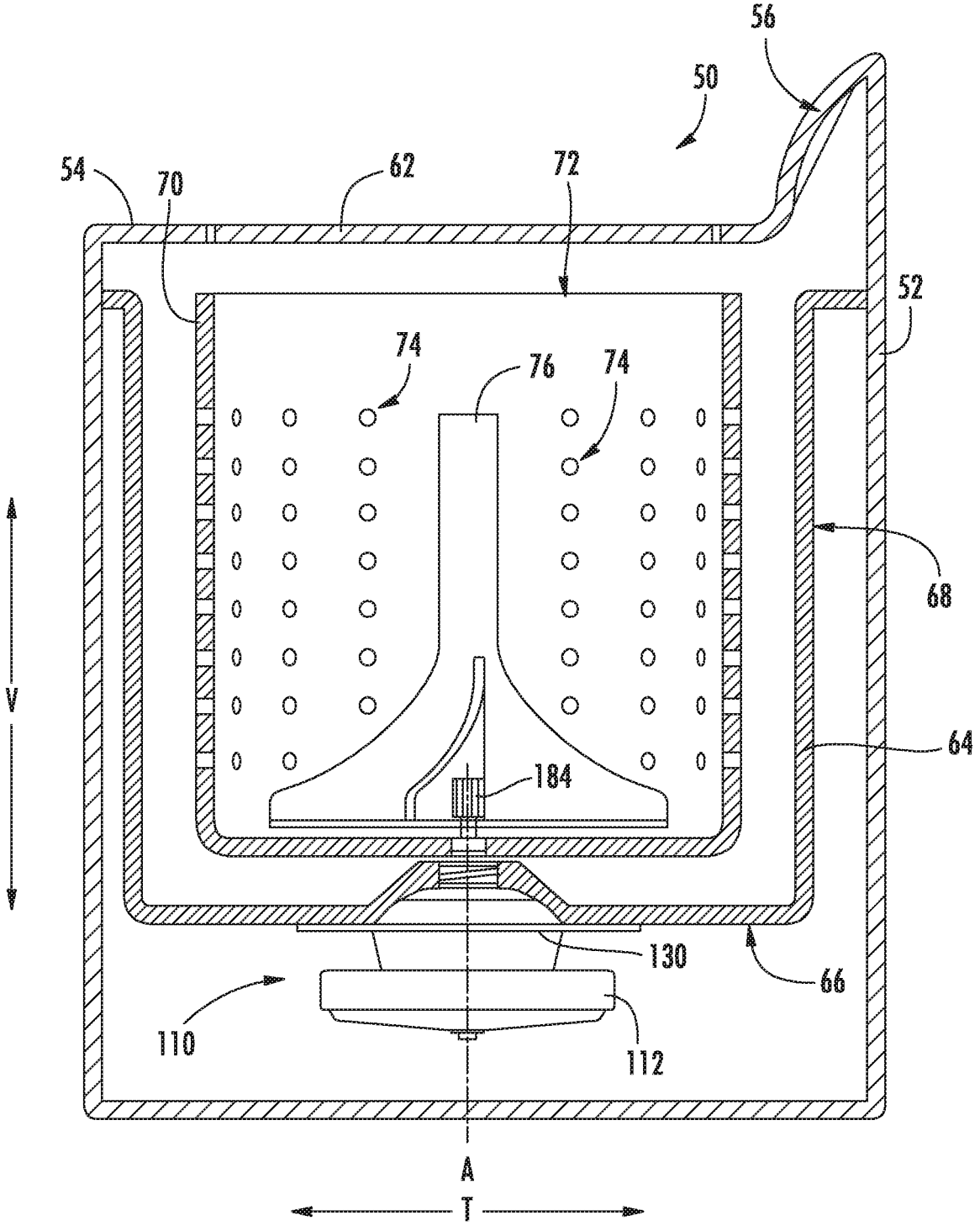
FIG. 2 provides a side cross-sectional view of the example washing machine appliance of FIG. 1.
Figure 3:
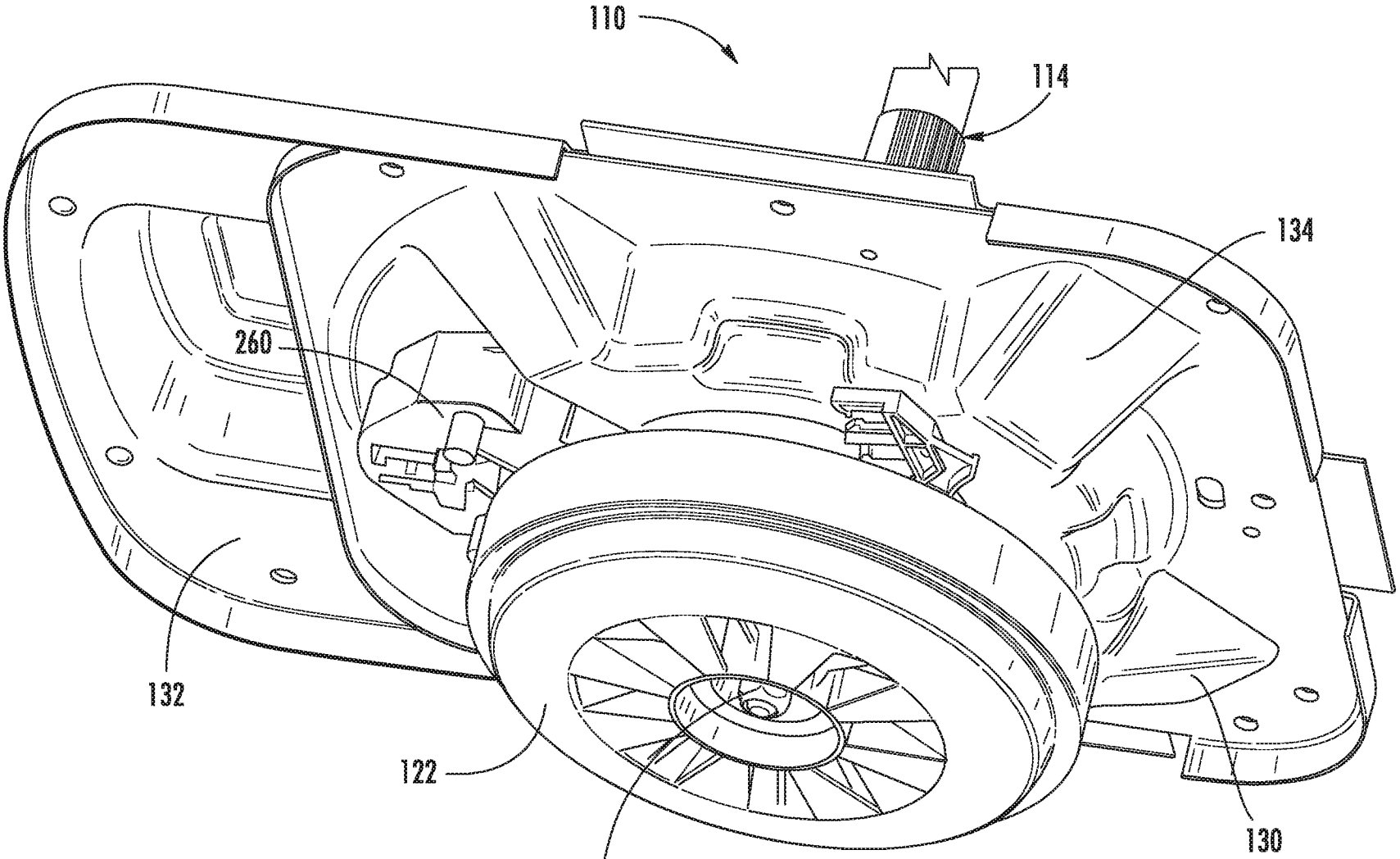
FIG. 3 provides a bottom perspective view of an example drive assembly for the example washing machine appliance of FIG. 1.

Turning now to the figures, FIG. 1 provides a perspective view of a washing machine appliance 50 according to example embodiments of the present disclosure. FIG. 2 provides a side cross-sectional view of the example washing machine appliance 50 of FIG. 1. As illustrated, washing machine appliance 100 generally defines a vertical direction V, a lateral direction L, and a transverse direction T, each of which is mutually perpendicular, such that an orthogonal coordinate system is generally defined.

As shown, washing machine 50 including a cabinet 52 and a top cover 54. FIG. 2 is a side cross-sectional view of the example embodiment of FIG. 1. A backsplash 56 extends from cover 54, and a control panel 58 including a plurality of input selectors 60 is coupled to backsplash 56. Control panel 58 and input selectors 60 collectively form a user interface input for operator selection of machine cycles and features. For example, in some embodiments, a display 61 indicates selected features, a countdown timer, and/or other items of interest to machine users.

A door or lid 62 is mounted to cover 54 and is rotatable about a hinge (not shown) between an open position (not shown) facilitating access to a wash tub 64 located within cabinet 52, and a closed position (shown in FIG. 1) forming an enclosure over wash tub 64. Wash tub 64 includes a bottom wall 66 and a sidewall 68. A basket 70 that is rotatably mounted within wash tub 64. A pump assembly (not shown) is located beneath tub 64 and basket 70 for gravity assisted flow when draining tub 64.

Referring now to FIG. 2, wash basket 70 is movably disposed and rotatably mounted in wash tub 64 in a spaced apart relationship from tub sidewall 68 and the tub bottom 66. Basket 70 includes an opening 72 for receiving wash fluid and a washload therein. Basket 70 includes a plurality of perforations 74 therein to facilitate fluid communication between an interior of basket 70 and wash tub 64.

An agitation element or agitator 76, such as a vane agitator, impeller, auger, or oscillatory basket mechanism, or some combination thereof is disposed in basket 70 to impart an oscillatory motion to articles and liquid in basket 70. In different embodiments, agitator 76 includes a single action element (i.e., oscillatory only), double action (oscillatory movement at one end, single direction rotation at the other end) or triple action (oscillatory movement plus single direction rotation at one end, single direction rotation at the other end). As illustrated in FIG. 2, agitator 76 and wash basket 70 are oriented to rotate about a drive axis A (which is substantially parallel to vertical direction V).

Operation of washing machine appliance 50 is controlled by a controller or processing device 108 (FIG. 1) that is connected (e.g., electrically coupled) to control panel 58 for user manipulation to select washing machine cycles and features. In response to user manipulation of control panel 58, controller 108 operates the various components of washing machine appliance 50 to execute selected machine cycles and features.

Controller 108 may include a memory and microprocessor, such as a general or special purpose microprocessor operable to execute programming instructions or micro-control code associated with a cleaning cycle. The memory may represent random access memory such as DRAM, or read only memory such as ROM or FLASH. In one embodiment, the processor executes programming instructions stored in memory. The memory may be a separate component from the processor or may be included onboard within the processor. Alternatively, controller 108 may be constructed without using a microprocessor, e.g., using a combination of discrete analog and/or digital logic circuitry (such as switches, amplifiers, integrators, comparators, flip-flops, AND gates, and the like) to perform control functionality instead of relying upon software. Control panel 58 and other components of washing machine appliance 50, including a drive assembly 110 (described below), may be in communication with controller 108 via one or more signal lines or shared communication busses.

In illustrative embodiments, laundry items are loaded into basket 70, and washing operation is initiated through operator manipulation of control input selectors 60 (shown in FIG. 1). Wash tub 64 is filled with water and mixed with detergent to form a wash fluid. The contents of basket 70 are agitated with agitator 76 for cleansing of laundry items in basket 70. More specifically, agitator 76 is moved back and forth in an oscillatory back and forth motion by drive assembly 110. In some embodiments, agitator 76 is rotated clockwise a specified amount about the drive axis A of the machine, and then rotated counterclockwise by a specified amount. The clockwise/counterclockwise reciprocating motion is sometimes referred to as a stroke, and the agitation phase of the wash cycle constitutes a number of strokes in sequence. Acceleration and deceleration of agitator 76 during the strokes imparts mechanical energy to articles in basket 70 for cleansing action. The strokes may be obtained in different embodiments with a reversing motor, a reversible clutch, or other known reciprocating mechanism.

After the agitation phase of the wash cycle is completed, tub 64 is drained with the pump assembly. Laundry items are then rinsed and portions of the cycle repeated, including the agitation phase, depending on the particulars of the cleaning process selected by a user. In certain embodiments, basket 70 is held in a fixed position during portions of the wash and rinse cycles while agitator 76 is oscillated as described.

One or more spin cycles may also be used as part of the cleaning process. In particular, a spin cycle may be applied after the wash cycle and/or after the rinse cycle in order to wring wash fluid from the articles being washed. During a spin cycle, basket 70 is rotated at relatively high speeds to help wring fluid from the laundry articles through holes 74.

Turning now to FIGS. 2 through 5, an example drive assembly 110 is provided. Drive assembly 110 generally includes a motor 112, a transmission assembly 114, and a clutch assembly 116 for rotating or oscillating wash basket 70 and/or agitator 76 during various operating cycles of washing machine appliance 50. More specifically, for example, transmission assembly 114 and clutch assembly 116 work together to selectively couple wash basket 70 and/or agitator 76 to motor 112, as described in more detail below.

According to the illustrated embodiment, drive motor 112 is a brushless DC electric motor, e.g., a pancake motor. However, according to alternative embodiments, drive motor 112 may be any other suitable type or configuration of motor. For example, may be an AC motor, an induction motor, a permanent magnet synchronous motor, a permanent split capacitor motor, or any other suitable type of motor. Moreover, according to alternative embodiments, drive motor 112 may be operably coupled to transmission assembly 114 through a belt pulley system or other mechanical linkage.

According to the illustrated embodiment, motor 112 includes a stator 120 and a rotor 122. When energized with the appropriate power, rotor 122 is caused to rotate while stator 120 remains fixed. For example, according to an exemplary embodiment, magnetic windings 124 are attached to stator 120. Each magnetic winding 124 may be formed from insulated conductive wire. When assembled, the magnetic windings 124 may be circumferentially positioned about drive axis A, e.g., to electromagnetically engage and drive rotation of rotor 122. Advantageously, the overall diameter of stator 120 and windings 124 may thus be reduced. Furthermore, a relatively small clearance may be required between stator 120 and rotor 122 (e.g., in a radial direction R relative to drive axis A).

To prevent stator 120 from rotating, washing machine appliance 100 includes a stationary housing 130 that is fixed to wash tub 64 such that it does not rotate about the axial direction A. More specifically, stator 120 is attached to a stationary housing 130 formed by an upper clam shell 132 and a lower clam shell 134. Bottom wall 66 of wash tub 64 is attached to upper clam shell 132 of stationary housing 130, e.g., using any suitable mechanical fastener. In addition to preventing the rotation of stator 120, stationary housing 130 forms a cavity 136 that may enclose transmission assembly 114 and/or clutch assembly 116.

As mentioned above, transmission assembly 114 and clutch assembly 116 operably couple drive motor 112 to wash basket 70 and/or agitator 76. In this regard, for example, transmission assembly 114 includes an agitator drive shaft assembly or agitator drive shaft 140 for driving agitator 76 and a wash basket drive shaft assembly or wash basket drive shaft 142 for driving wash basket 70. Each of these drive shaft assemblies will be described in more detail below.

Agitator drive shaft 140 extends from (e.g., in fixed attachment to) agitator 76 (FIG. 2) at a first end 150. During operations, agitator drive shaft 140 may thus rotate with agitator 76. Similarly, wash basket drive shaft 142 extends from (e.g., in fixed attachment to) wash basket 70 (FIG. 2) at first end 152. During operations, wash basket drive shaft 142 may thus rotate with wash basket 70. Notably, any suitable mechanical coupling may be used at first ends 150, 152, such as a mechanical fastener, a geared arrangement, or a welded connection. In example embodiments, one or both of wash basket drive shaft 142 and agitator drive shaft 140 extend along the drive axis A. In turn, wash basket drive shaft 142 may be concentric with agitator drive shaft 140.

Notably, agitator drive shaft 140 can rotate within wash basket drive shaft 142 even if wash basket drive shaft 142 (and, therefore, wash basket 70) is held in a fixed position. Wash basket drive shaft 142 can also rotate within upper and lower clam shells 132 and 134 of stationary housing 130, which is mounted on wash basket drive shaft 142 using a pair of bearings 154. The position of wash basket drive shaft 142 can be fixed to hold wash basket 70 stationary while agitator 76 is oscillated during e.g., a wash or rinse cycle. Alternatively wash basket drive shaft 142 and, therefore, wash basket 70 can also be rotated with agitator 76 during a spin cycle. According to an exemplary embodiment, rotation of wash basket drive shaft 142 may be regulated using a clutch assembly for engaging and disengaging wash basket drive shaft 142 to drive motor 112, as will be described in more detail below.

Figure 6:
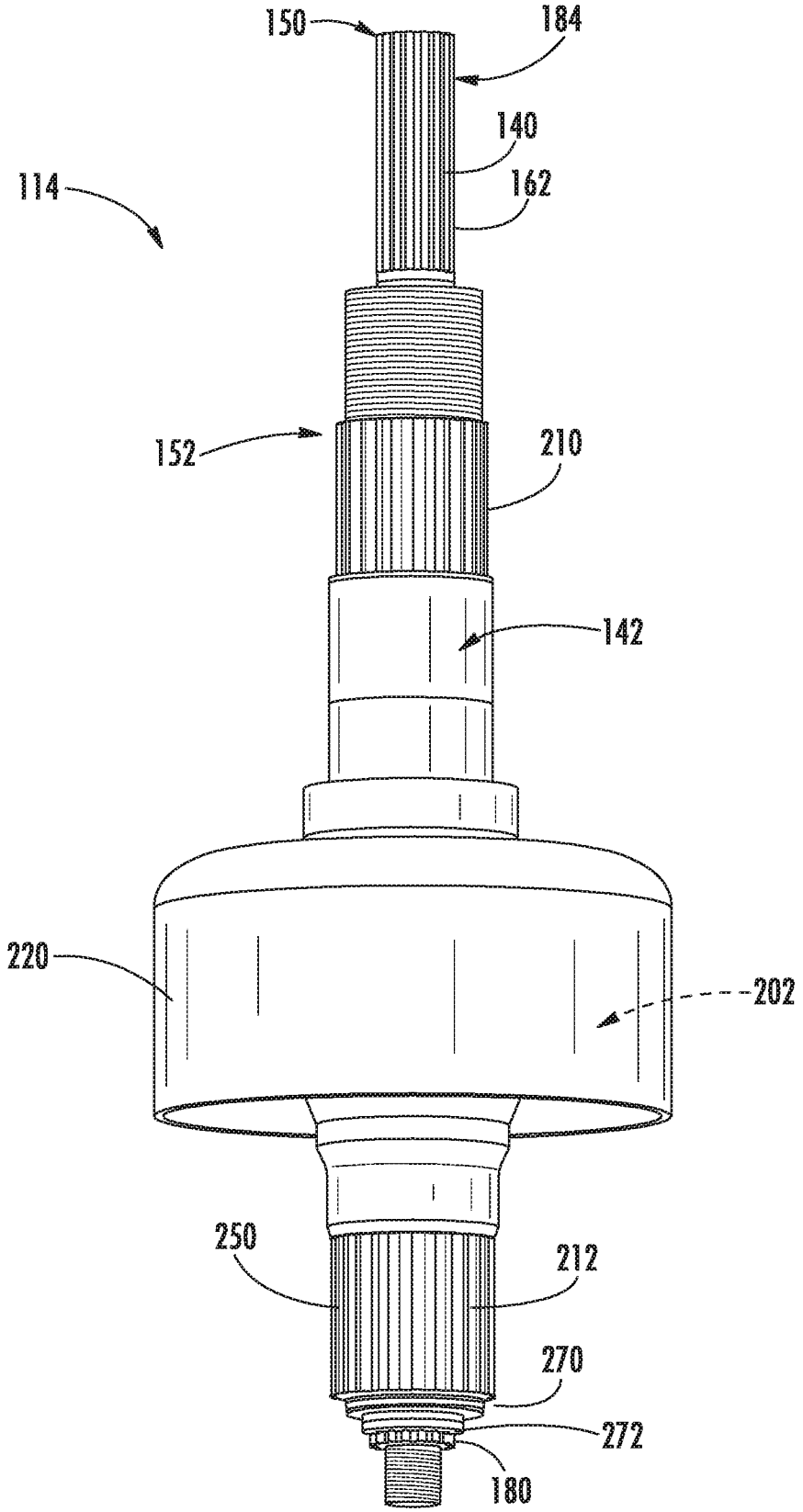
FIG. 6 provides a perspective view of a transmission assembly of the exemplary washing machine appliance of FIG. 1 according to an exemplary embodiment of the present subject matter.
Figure 7:
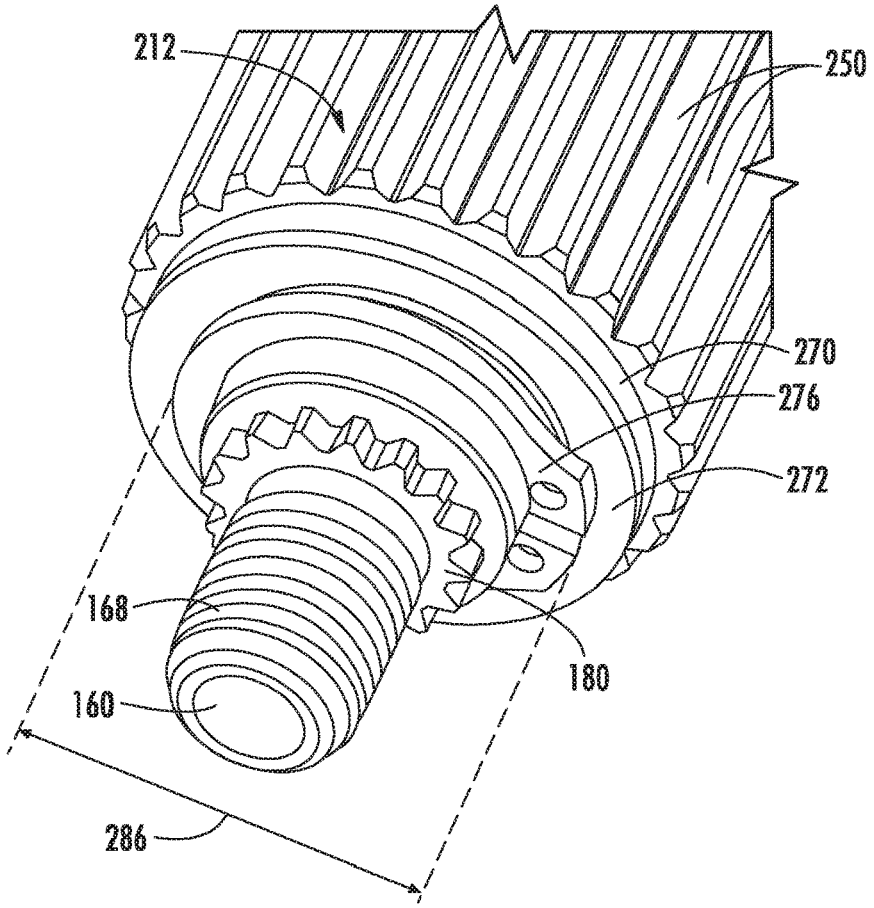
FIG. 7 is a close-up, perspective view of an end of the exemplary transmission assembly of FIG. 6 according to an exemplary embodiment of the present subject.
Figure 8:
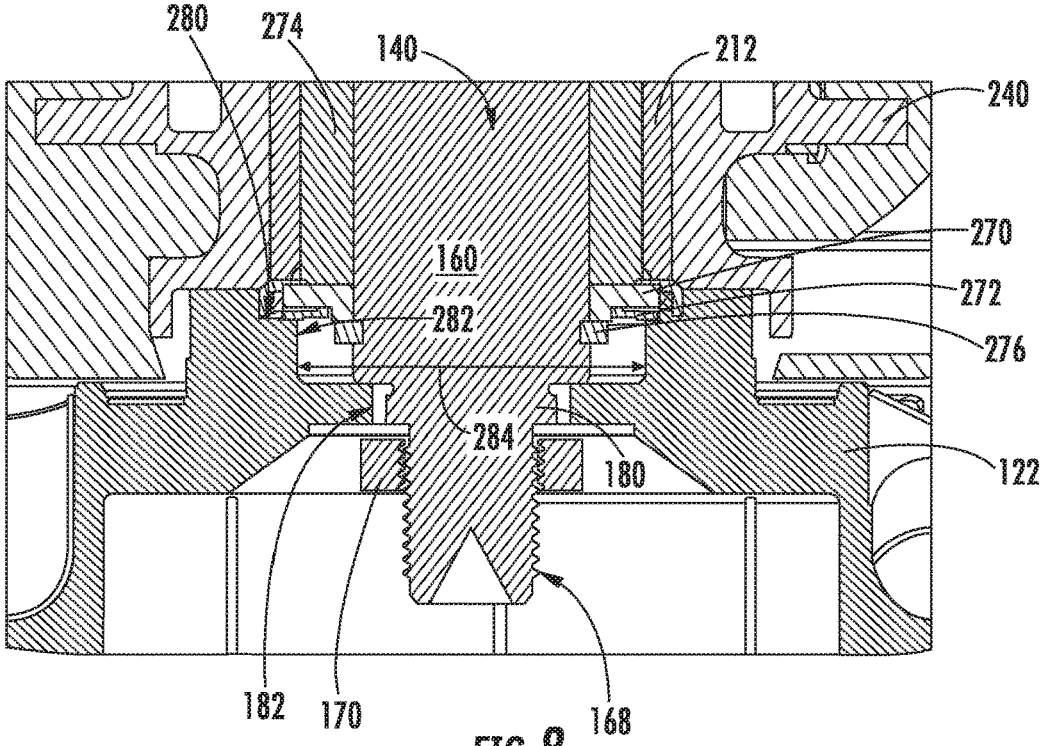
FIG. 8 provides a cross sectional view of the exemplary transmission assembly of FIG. 6 installed in the exemplary washing machine appliance of FIG. 1 according to an exemplary embodiment of the present subject matter.

Referring now to FIGS. 6 through 8, agitator drive shaft 140 is operably coupled to rotor 122 for driving agitator 76. More specifically, agitator drive shaft 140 includes an input shaft 160 and an output shaft 162. Input shaft 160 is fixedly attached to rotor (e.g., such that it does not rotate relative to rotor 122). In this regard, input shaft 160 passes through a central stator opening 164 (FIG. 4) that may be defined along the drive axis A. In addition, rotor 122 defines a central rotor opening 166 through which a threaded portion 168 of input shaft 160 extends. The threaded portion 168 is configured for receiving a nut 170 (FIG. 8) that is screwed onto the threaded portion 168 for coupling the input shaft 160 to rotor 122.

As best shown in FIGS. 7 and 8, input shaft 160 may further define a centering spline 180 that is configured to engage a complementary splined surface 182 defined by rotor 122. In this manner, input shaft 160 and rotor 122 are rotationally fixed such that input shaft 160 rotates with rotor 122. In addition, agitator drive shaft 140 extends along drive axis A (e.g., vertically) and is connected with a coupling 184 (FIG. 2) defined on first end 150 of agitator drive shaft (e.g., at the end opposite of threaded portion 168). More specifically, coupling 184 is defined on a first end 150, or a top end of output shaft 162.

According to an exemplary embodiment, transmission assembly 114 further includes a gear train that couples input shaft 160 to output shaft 162. Any suitable number of gears having any suitable style and configuration may be used according to exemplary embodiments. However, according to the illustrated embodiment, transmission assembly 114 includes a plurality of helical gears 200 that form a planetary gear train 202. Helical gears 200 may be driven, for example, by a helical drive gear 204 defined by an upper end of input shaft 160, such that rotation of rotor 122 drives planetary gear train 202. In addition, output shaft 162 may extend along the drive axis A (e.g., vertically) from the planetary gear train 202 to coupling 184 of agitator drive shaft 140.

In addition, planetary gear train 202 may operably connect an upper member 210 and a lower member 212 of wash basket drive shaft 142. More specifically, upper member 210 extends along the drive axis A (e.g., vertically) between wash basket 70 and planetary gear train 202 while lower member 212 extends along the drive axis A (e.g., vertically) between planetary gear train 202 and rotor 122.

As shown, planetary gear train 202 includes a housing 220 enclosing a meshed sun gear 222 and one or more planet gears 224. Planet gears 224 may be rotatably attached on a carrier plate 226. In the illustrated embodiments, carrier plate 226 is fixed to the output shaft 162 of agitator drive shaft 140. Thus, carrier plate 226 and output shaft 162 of agitator drive shaft 140 may operate to follow the revolution path of planet gears 224 about sun gear 222. Additionally or alternatively, sun gear 222 may be fixed to input shaft 160 of agitator drive shaft 140. For instance, sun gear 222 may be formed on a portion of input shaft 160 that is disposed within housing 220.

In some embodiments, a housing 220 joins upper member 210 and lower member 212 of wash basket drive shaft 142, e.g., as a part of drive shaft 142. In other words, planet gears 224 and sun gear 222 may be mounted within housing 220 between upper member 210 and lower member 212 of wash basket drive shaft 142. Moreover, a ring gear 230 may be mounted within housing 220. For instance, ring gear 230 may be in fixed or integral attachment with upper member 210. Additionally or alternatively, ring gear 230 may be in fixed or integral attachment to an internal surface of a wall of housing 220. When assembled, ring gear 230 may be meshed with planet gears 224, e.g., radially outward therefrom.

Figure 4:
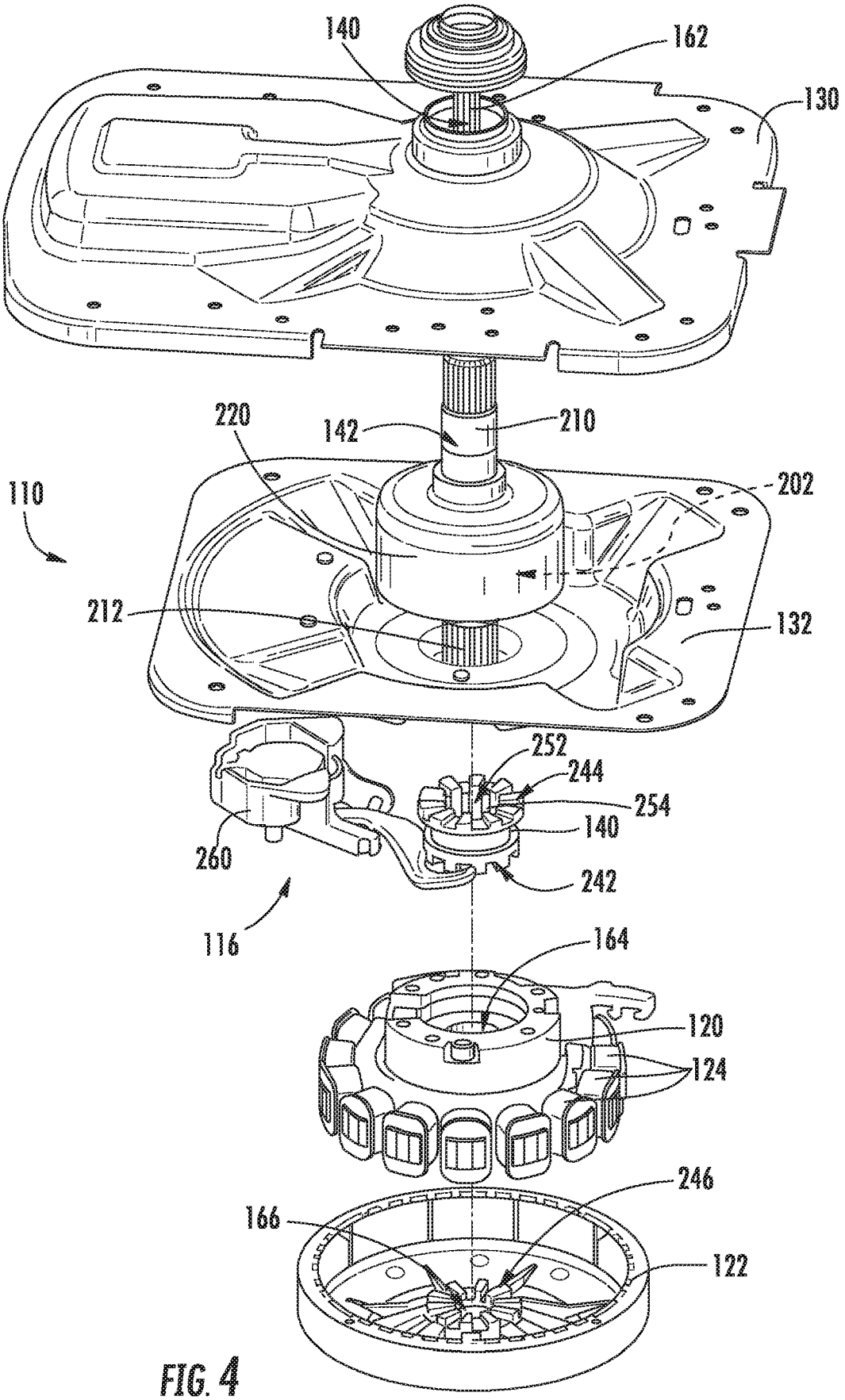
FIG. 4 provides an exploded perspective view of the example drive assembly of FIG. 3.

As mentioned briefly above, drive assembly 110 further includes a clutch assembly 116 for selectively coupling rotor 122 to wash basket drive shaft 142. Clutch assembly 116 includes a clutch 240 that may slide up and down along lower member 212 of wash basket drive shaft 142. As shown in FIG. 4, clutch 240 defines a plurality of lower teeth 242 along a bottom surface of clutch 240 and a plurality of upper teeth 244 along a top surface of clutch 240. Lower teeth 242 are positioned to selectively mesh with a plurality of rotor teeth 246 (e.g., FIG. 4) on rotor 122 (e.g., when clutch 240 is an engaged position so as to rotate wash basket 70). Conversely, upper teeth 244 are positioned to selectively mesh with a plurality of stator teeth (not shown) on stator 120 (e.g., when clutch 240 is in a disengaged position so that wash basket 70 is precluded from rotating while agitator 76 is rotated).

During certain cycles (e.g., a wash cycle), a clutch 132 is in a downward position such that rotation of sun gear 222 (e.g., by rotor 122) drives planet gears 224, which rotate within ring gear 230. Ring gear 230 may be rotationally fixed with wash basket drive shaft 142 such that wash basket 70 (FIG. 2) does not rotate. During other cycles (e.g., a spin cycle), clutch 132 is in an upward position such that wash basket drive shaft 142 and ring gear 230 rotate, while output shaft 162 of agitator drive shaft 140 remains stationary.

Figure 5:
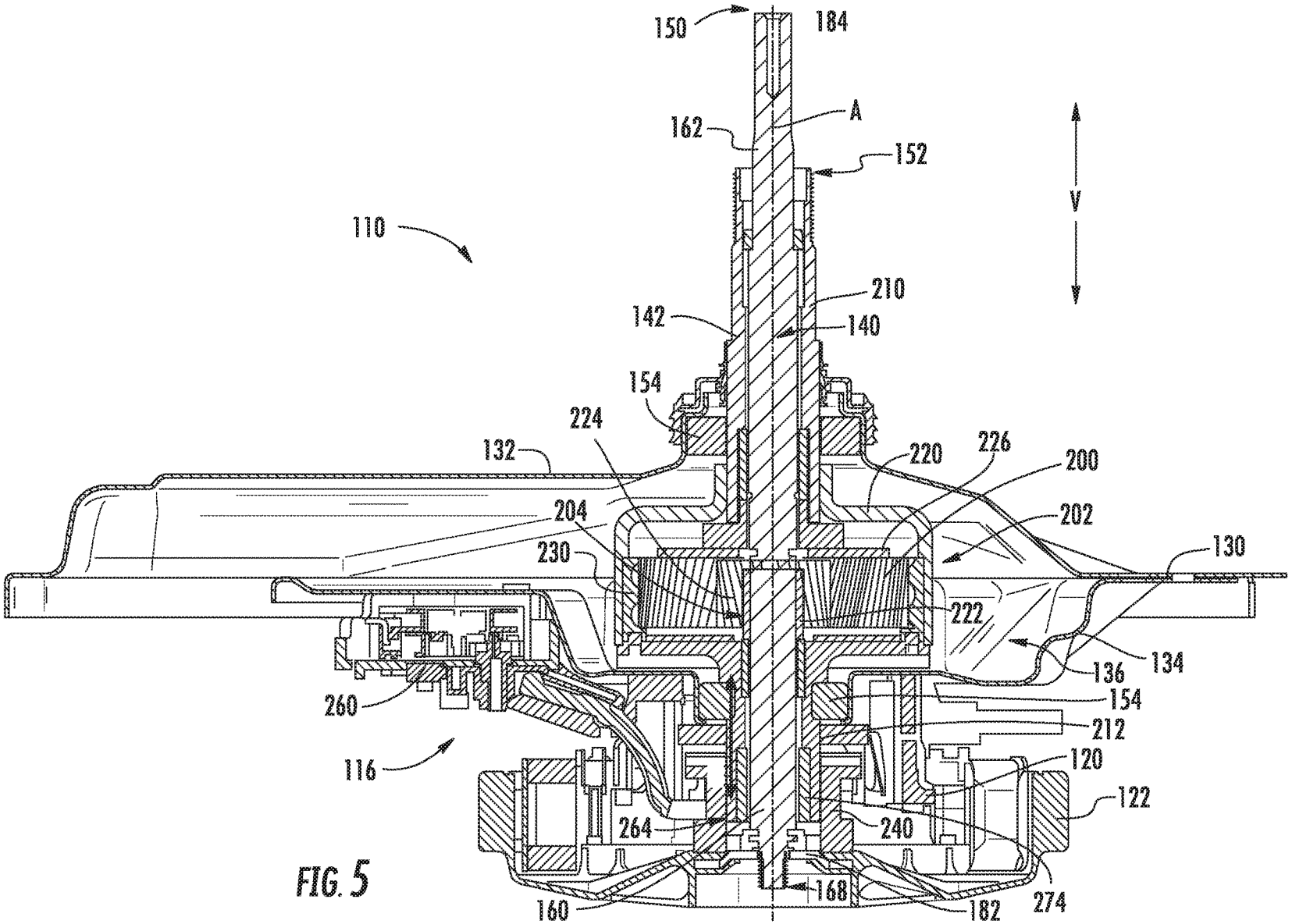
FIG. 5 provides a side cross-sectional view of the example drive assembly of FIG. 3, wherein the drive assembly in a downward engaged position.

In FIG. 5, clutch 240 is shown in a downward position in which wash basket drive shaft 142 is engaged with rotor 122 such that wash basket 70 and agitator 76 (FIG. 2) are rotated simultaneously by rotor 122. By contrast, when clutch 240 is in an upward position (not shown), wash basket drive shaft 142 is disengaged from rotor 122 such that the rotation of wash basket 70 is prevented while agitator 76 is rotated (e.g., during wash and rinse cycles). In this position, clutch 240 is engaged with stationary housing 130, which is attached to wash tub 64 (FIG. 2). Specifically, clutch 240 contacts stator 120 through teeth upper teeth 244.

As shown in FIG. 7, the outside surface of lower member 212 of wash basket drive shaft 142 includes a first plurality of spline teeth 250 oriented along the vertical direction V and positioned circumferentially about wash basket drive shaft 142. Clutch 240 defines a central opening 252 along drive axis A (FIG. 4) into which the wash basket drive shaft 142 is slidably received. Clutch 240 defines a second plurality of spline teeth 254 (FIG. 4) that mesh with spline teeth 250. As shown, teeth 250 and 254 are positioned on opposing sides of clutch 240 along vertical direction V. Accordingly, clutch 240 can shift along wash basket drive shaft 142 in vertical direction V while, at the same time, the rotation of clutch 240 will cause wash basket drive shaft 142 to also rotate. According to the illustrated embodiment, drive assembly 110 further includes a clutch positioning assembly 260 to selectively force clutch 240 between and engaged and disengaged position.

Notably, the use of helical gears 200 in planetary gear train 202 provides advantages in terms of gear contact ratio, torque transmission, and lower noise. However, in contrast to standard spur gears, helical gears 200 may have a tendency to generate an axial load on input shaft 160. In this regard, for example, when input shaft 160 applies a torque to planetary gear train 202 or changes direction, the interaction between the helical teeth of planet gears 224 with the helical teeth of sun gear 222 can generate a force along the axial direction A. This axial load may result in undesirable noises and premature wear on transmission assembly 114 and drive assembly 110.

Therefore, according to exemplary embodiments of the present subject matter, transmission assembly 114 may include features for compensating or absorbing the axial load generated by helical gears 200. More specifically, as illustrated in FIGS. 6 through 8, transmission assembly 114 may include a thrust bearing or thrust bushing 270 that is positioned around input shaft 160 and a spring element 272 that is positioned around input shaft 160 and between thrust bushing 270 and rotor 122 of drive motor 112.

More specifically, as best shown in FIG. 8, transmission assembly 114 includes a lower shaft bearing or lower shaft bushing 274 that is positioned around input shaft 160 and facilitates rotation of input shaft 160 about the axial direction A. Notably, lower shaft bushing 274 is fixed relative to input shaft 160 along the axial direction A. Thrust bushing 270 is positioned between spring element 272 and lower shaft bushing 274 along the axial direction A to provide a low friction interface. In order to simplify the assembly of drive assembly 110 and the installation of transmission assembly 114, thrust bushing 270 and spring element 272 are retained on input shaft 160 using a retention clip 276, such as a C-clip retainer.

When transmission assembly 114 is installed within drive assembly 110 of washing machine appliance 100, threaded portion 168 of input shaft 160 is passed through central rotor opening 166 and tightened by nut 170. More specifically, rotor 122 defines a shoulder 280 for engaging spring element 272. In order to permit the insertion of input shaft 160 through central rotor opening 166 without contacting retention clip 276, shoulder 280 defines a central channel 282 having a channel diameter 284. Notably, channel diameter 284 is greater than a maximum diameter 286 of retention clip 276, such that retention clip 276 may slide through central channel 282 to permit proper installation of transmission assembly 114.

According to the illustrated embodiment, spring element 272 is a Belleville or conical spring washer. However, it should be appreciated that any other suitable type of spring element may be used according to alternative embodiments. For example, spring element 272 may be a coil spring, a wave spring, a spring washer, or any other suitable mechanical spring. In this manner, as nut 170 engages threaded portion 168, input shaft 160 is fixedly attached to rotor 122 and spring element 272 is loaded between thrust bushing 270 and shoulder 280 of rotor 122. Thus, axial movement of input shaft 160 is prevented and undesirable wear and clicking noises are prevented.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A washing machine appliance defining a vertical, a lateral, and a transverse direction, the washing machine appliance comprising:

a wash tub positioned within a cabinet;

a wash basket rotatably mounted within the tub, the wash basket defining a wash chamber for receiving articles for washing;

an agitator rotatably mounted within the wash basket to impart motion to the articles within the wash chamber;

a motor operably coupled to a rotor, the rotor having a central rotor opening; and a transmission assembly selectively coupling the rotor to the agitator and the wash basket, the transmission assembly comprising:

a plurality of helical gears;

an input shaft fixedly attached to the rotor and being operably coupled with at least one of the plurality of helical gears, the input shaft defining a threaded portion that extends through the central rotor opening;

a thrust bushing or a thrust bearing positioned around the input shaft;

a spring element positioned adjacent the thrust bushing or the thrust bearing between the thrust bushing or the thrust bearing and a shoulder defined by the rotor; and a nut screwed onto the threaded portion of the input shaft to couple the input shaft to the rotor and to load the spring element.

2. The washing machine appliance of claim 1, wherein the plurality of helical gears form a planetary gear train.

3. The washing machine appliance of claim 2, comprising:

an agitator drive shaft extending from the agitator to rotate therewith; and a wash basket drive shaft extending from the wash basket to rotate therewith, the wash basket drive shaft being selectively coupled to the rotor through a clutch assembly.

4. The washing machine appliance of claim 3, wherein the planetary gear train comprises:

a sun gear defined by the input shaft;

three planetary gears operably coupled to the agitator drive shaft; and a ring gear operably coupled to the wash basket drive shaft.

5. The washing machine appliance of claim 1, wherein the thrust bushing or the thrust bearing and the spring element are retained on the input shaft using a retention clip.

6. The washing machine appliance of claim 5, wherein the shoulder engages the spring element, the shoulder defining a central channel having a channel diameter that is greater than a maximum diameter of the retention clip.

7. The washing machine appliance of claim 1, wherein the transmission assembly further comprises a lower shaft bushing or bearing positioned around the input shaft and being fixed along an axial direction, and wherein the thrust bushing or the thrust bearing is positioned between the lower shaft bushing or bearing and the spring element.

8. The washing machine appliance of claim 1, wherein the spring element is selected from a group consisting of a Belleville washer, a coil spring, a wave spring, and a spring washer.

9. The washing machine appliance of claim 1, wherein the motor comprises a stator rotationally fixed at a position radially inward from the rotor.

10. The washing machine appliance of claim 1, wherein the motor is a brushless DC pancake motor.

11. The washing machine appliance of claim 1, wherein the washing machine appliance is a vertical axis washing machine appliance.

12. A transmission assembly for selectively coupling a motor to an agitator and a wash basket of a washing machine appliance, the transmission assembly comprising:

a plurality of helical gears;

an input shaft fixedly attached to a rotor operably coupled with the motor and being operably coupled with at least one of the plurality of helical gears;

a thrust bushing or a thrust bearing positioned around the input shaft;

a spring element positioned adjacent the thrust bushing or the thrust bearing between the thrust bushing or the thrust bearing and a shoulder defined by the rotor; and a retention clip for retaining the thrust bushing or the thrust bearing and the spring element on the input shaft, wherein the shoulder engages the spring element, the shoulder defining a central channel having a channel diameter that is greater than a maximum diameter of the retention clip.

13. The transmission assembly of claim 12, wherein the plurality of helical gears form a planetary gear train.

14. The transmission assembly of claim 13, comprising:

an agitator drive shaft extending from the agitator to rotate therewith; and a wash basket drive shaft extending from the wash basket to rotate therewith, the wash basket drive shaft being selectively coupled to the rotor through a clutch assembly.

15. The transmission assembly of claim 14, wherein the planetary gear train comprises:

a sun gear defined by the input shaft;

three planetary gears operably coupled to the agitator drive shaft; and a ring gear operably coupled to the wash basket drive shaft.

16. The transmission assembly of claim 12, comprising a lower shaft bushing or bearing positioned around the input shaft and being fixed along an axial direction, and wherein the thrust bushing or the thrust bearing is positioned between the lower shaft bushing or bearing and the spring element.

17. The transmission assembly of claim 12, wherein the spring element is selected from a group consisting of a Belleville washer, a coil spring, a wave spring, and a spring washer.

18. A transmission assembly for selectively coupling a motor to an agitator and a wash basket of a washing machine appliance, the transmission assembly comprising:

a plurality of helical gears;

an input shaft fixedly attached to a rotor operably coupled with the motor and being operably coupled with at least one of the plurality of helical gears, the input shaft defining a threaded portion that extends through a central rotor opening of the rotor;

a thrust bushing or a thrust bearing positioned around the input shaft;

a spring element positioned adjacent the thrust bushing or the thrust bearing between the thrust bushing or the thrust bearing and a shoulder defined by the rotor; and a nut screwed onto the threaded portion of the input shaft to couple the input shaft to the rotor and to load the spring element.

19. The transmission assembly of claim 18, comprising a lower shaft bushing or bearing positioned around the input shaft and being fixed along an axial direction, and wherein the thrust bushing or the thrust bearing is positioned between the lower shaft bushing or bearing and the spring element.

20. The transmission assembly of claim 18, wherein the spring element is selected from a group consisting of a Belleville washer, a coil spring, a wave spring, and a spring washer.

* * * * *